106-89

United States Patent [19]

Salazar

[11] Patent Number: 4,590,726

[45] Date of Patent: May 27, 1986

[54] DECORATIVE FACING

[76] Inventor: Edward J. Salazar, 400 Diamond, Fort Collins, Colo. 80525

[21] Appl. No.: 503,024

[22] Filed: Jun. 10, 1983

[51] Int. Cl.[4] ..... E04C 1/00; E04C 2/24; C04B 7/02

[52] U.S. Cl. ..... 52/314; 52/311; 52/746; 106/89; 264/255

[58] Field of Search ..... 52/314, 746, 311; 264/157, 255; 106/89

[56] References Cited

U.S. PATENT DOCUMENTS 3,503,165 3/1970 Hardt ..... 52/314
3,660,214 5/1972 Nichols et al. ..... 52/314 X
3,905,170 9/1975 Huettemann ..... 52/314 X
4,319,927 3/1982 Segal ..... 106/89

FOREIGN PATENT DOCUMENTS 2261 1/1983 Japan ..... 106/89

*Primary Examiner*—J. Karl Bell
*Attorney, Agent, or Firm*—Dean P. Edmundson

[57] ABSTRACT

Decorative facing and method for applying same are described. The facing comprises Portland cement, sand, and pigmented binder. The facing may be applied to various surface or molded into individual elements of various shapes and thicknesses. The facing is slow-cured and exhibits compressive strength of at least 1500 p.s.i. and high temperature color fastness.

20 Claims, 6 Drawing Figures

DECORATIVE FACING

FIELD OF THE INVENTION

This invention relates to decorative facing materials and techniques. More particularly, this invention relates to materials and techniques for providing decorative facing on a variety of substrates.

BACKGROUND OF THE INVENTION

In the construction and finishing trades there have been many prior attempts to simulate a brick, stone or tile surface using materials less expensive than the genuine material. Some of these attempts involved cutting the genuine brick, stone, etc. into thin slabs which are then adhered to a conventional concrete wall, etc. for support. See, for example, U.S. Pat. Nos. 3,131,514; 1,669,351; 3,660,214; 3,740,910; 3,521,418; 3,775,916; 3,646,715; 2,122,696; 2,149,784; 2,339,489; 3,426,490; and 1,902,271. The expense, time, and care involved in cutting the brick or stone, etc. into desired thin slabs and then adhering them to the desired surface or substrate detract from the advantages of such techniques.

Another attempt to simulate a brick, stone, tile, etc. exterior involves pouring a mortar or concrete mix into a mold or form which includes the desired relief, e.g., brick, stone, etc. This technique is described, for example, in U.S. Pat. Nos. 3,002,322 and 3,874,140. Various limitations are inherent in this technique. For example, in order for the concrete or mortar mix to properly and completely fill the molds without leaving air pockets the mix must contain a considerable amount of water. This detracts from the strength of the cured mixture and increases the curing time. The finished product unfortunately still has the appearance of concrete and is all the same color, i.e., it does not have one color for the bricks or stone relief and a different color for the spacing between the brick or stone shapes. Moreover, it is difficult if not impossible to obtain sharp edges on the brick or stone shapes in these molds. As a result, the shapes are not as realistic as desired.

Another technique simply involved making panels or sections from plastic which has been molded to the desired relief. The panels or sections are then used as the outer decorative facing for the structure to be covered. See, for example, U.S. Pat. Nos. 3,882,218; 3,177,279; and 3,232,017. Of course, these products do not provide a totally realistic appearance and would not be adequate as a substitute for real brick, stone, tile, etc. in all situations.

Still another technique involved making simulated brick or tile elements out of plastic and then bonding them to a supporting panel or sheet with adhesive. See U.S. Pat. Nos. 3,991,529 and 4,079,554. Again, such a technique includes serious limitations.

Yet another technique involved forming two layers of magnesite applied to a metal lathe. The second layer is of a different color than the first layer. Before the second layer hardens, grooves are cut therethrough to form the shape of bricks, for example, and to reveal the underlying layer of magnesite. See U.S. Pat. No. 1,583,748.

Another cumbersome technique described in U.S. Pat. No. 3,426,490 involves forming individual brick veneer blocks made of concrete or fired clay which are adhered to a wire mesh in panel form. The panels are then secured to a wall with nails or staples. Mortar is then applied between the veneer blocks and forced into the wire mesh.

U.S. Pat. No. 3,496,694 describes yet another method in which molded formations made from cementitious plaster, plastic, or other suitable decorative material are adhered to a flexible base material. The prefabricated material may then be rolled up and transported to the job site where it is attached to the frame of a building.

U.S. Pat. No. 3,868,801 describes a building panel for a prefabricated house. The panel includes masonry elements (such as bricks), polyester mortar, wire mesh, polymer foam, and inner facing layers are held together by the mortar and foam.

U.S. Pat. No. 3,344,570 describes a reinforced flooring tile including a body of concrete with reinforcing framework embedded therein. The network is thermoplastic synthetic resin or metallic reinforcing.

U.S. Pat. No. 3,067,545 describes an artificial siding for frame buildings. A brick-like block is made of standard concrete block mixture which may include coloring pigments and water-proofing agents. The block is molded on metal mesh in such a manner that it extends through the mesh. The exterior surface of the walls of the building are covered with wooden sheathing and then felt paper. The brick/mesh pieces are then nailed to the wall individually as siding in such a manner that the mesh overlaps the mesh of the piece in the row below it. Presumably the spaces between adjacent bricks would have to be sealed in some manner U.S. Pat. No. 2,819,495 describes a method for making building blocks having a molded mortar surfacing simulating a plurality of bricks or stones. The mortar is first placed into a mold and must be tamped into compartments; then additional intermediate layers are added, after which concrete mix is added to form the main portion of the block. A disadvantage of this technique is that the facing is applied to the concrete block prior to the required conventional steam or oven curing of the block. Accordingly, additional care is required to handle such blocks prior to curing.

U.S. Pat. No. 2,748,443 describes a particular technique (involving a specially designed stencil) for applying a plastic mix, like mortar, to the face of a building in a predetermined pattern to simulate stone blocks. However, the wall to be faced is first covered with lathing over which is provided a continuous coating of plastic mix and then a brown coat. Then the mortar mix is applied with the aid of the stencil. This technique, of course, would not be practical for use with individual building blocks, nor is it a convenient technique even for large building faces.

U.S. Pat. No. 1,571,849 describes a multi-step method for making building blocks which is similar to that described in U.S. Pat. No. 2,819,495. A grate is placed on a flat plate and a concrete mix is then placed into the openings in the grate and must be tamped down until it is even with the top of the grate. The grate is then removed and the spaces between the shapes formed by the grate are filled with cementitious compost colored differently than the shapes left by the grate. Then another concrete mixture is added to form another layer. The resulting structure is then removed from the mold on the flat plate and placed in the bottom of a mold of a cement block forming machine where the main portion of a cement block is formed on top.

U.S. Pat. No. 2,618,815 describes a rather involved and tedious method for applying a coating of plaster or cement to a wall to simulate the appearance of stone, cement blocks, or similar construction units. A plastic mold is filled with a concrete and mortar mix. The mold is then placed against a wall until the mortar mix adheres and sets (may be of the order of three hours). Alternatively, the mold may be coated with an adhesive coating such as a mixture of paraffin and kerosene. Marble dust, quartz particles or the like are then spread onto the coating, followed by ground stone particles. The mold is then filled with the mortar mix. Then the mortar mix may be pressed against the wall and the mold removed immediately, leaving the marble dust and paraffin-kerosene coating covering the mortar.

U.S. Pat. No. 2,130,911 describes a prefabricated building unit in which a first layer is applied directly onto a Celotex, fiber board, etc. The first layer may be plaster or cement (0.25 to 2 inches thick). Then facing elements made from natural stone, cement, wood, metal, linoleum or the like are pressed onto the surface of the first layer while either or both are in a plastic or semi-cured condition. Alternatively, the facing elements may be secured to the first layer by cement or adhesive. The facing elements may be pre-formed or may be formed from a plastic material on the base member in a continuous operation.

U.S. Pat. No. 3,304,673 describes a pre-cast panel which is adapted to be keyed to adjacent panels with specially formed inserts. The panel includes a base layer of cement and an embossed outer layer which simulates brick. Before the base layer is set the outer layer is added and then a mold is impressed against the surface of the outer layer to emboss it and provide a simulated brick facing. The outer layer may include pigments for coloring. Alternatively, the outer layer may be cast in a separate mold, hardened, and then laid in place over the first layer.

SUMMARY OF THE INVENTION

In accordance with the present invention there are provided simple, efficient, and effective techniques for forming a decorative facing. The facing may be formed directly on a wide variety of substrates and surfaces or it may be formed, transported, stored, and used as individual units, as desired. For example, the facing may be formed in situ on concrete blocks, walls, floors, slabs, driveways, walkways, cinder bricks, ceiling tiles, fiber board, wood (e.g., plywood, particle board), and so forth. The facing material may also be made in the form of individual units having a variety of shapes, e.g., thin brick elements, quarry tiles, etc. The decorative facing is useful for both interior and exterior facing, and it has the feel and appearance of conventional fired brick.

In one embodiment there is provided a decorative brick element having a thickness in the range of about 0.15 to 0.2 inches. The brick element comprises a cured molded mixture of Portland cement, sand, and pigmented binder. The brick element has high strength and good color fastness (i.e., it does not easily fade even at high temperatures).

In other embodiments the decorative facing is applied directly to concrete and cinder bricks, concrete blocks, floors, walls, slabs, etc. where it hardens in place.

In yet another embodiment a prefabricated panel is provided having a decorative facing.

BRIEF DESCRIPTION OF THE DRAWINGS

The invention is described in more detailed hereinafter with reference to the accompanying drawings wherein like reference characters refer to the same parts throughout the several views and in which.

DETAILED DESCRIPTION OF THE INVENTION

Figure 1:
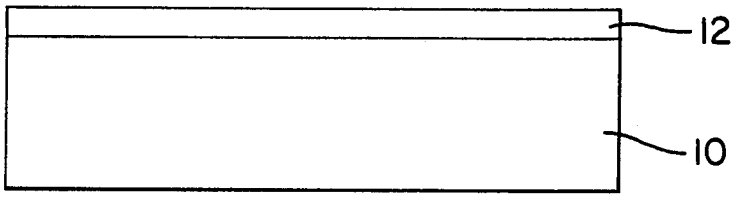
FIG. 1 is a side view of a concrete or cinder brick bearing a decorative facing in accordance with one embodiment of the invention.

Thus, in FIG. 1 there is shown a conventional concrete or cinder brick 10 on one surface of which has been applied a decorative facing 12 in accordance with this invention. A conventional cinder brick is a fired material which is lighter than a traditional facing brick. A concrete brick has high strength and is therefore suitable for load-bearing applications. The cost of the concrete brick and the cinder brick is considerably less than the cost for a traditional facing brick. Accordingly, the technique of the present invention, involving the application of a thin decorative, durable and inexpensive facing on a conventional concrete or cinder brick, is a very economical way to obtain the advantages of a traditional brick appearance and durability while avoiding the high cost of the traditional brick.

The decorative facing 12 preferably comprises a mixture of Portland cement, sand, and pigmented binder which are mixed with sufficient water to obtain the desired consistency.

After the wet composition is prepared the desired surface of the cinder brick to be coated is dipped into the wet composition which then adheres to the surface of the brick at a thickness in the range of about 0.05 to 0.2 inch. The thickness of the coating may be adjusted by increasing or decreasing the amount of water in the wet composition. The greater the amount of water in the composition the thinner the coating will be. The coated brick surface is then placed directly on an air-impervious surface (such as plastic, plywood, etc.) at room temperature (normally 40°–80° F.) and not exposed to air or sunlight for 24 hours. The resulting cured facing is very hard and has the appearance of conventional fired brick. The facing also exhibits high temperature color fastness (i.e., the facing can withstand a temperature of 1000° F. for at least one hour without deterioration or cracking of the facing and without undesirable fading of the color. The compressive strength characteristic of the facing material is at least 1500 p.s.i. (as measured on a 2 inch cube of cured material in accordance with standard testing as used by engineering laboratories to test mortar mix.

Moistening the surface against which the coated brick is placed after dipping or coating will result in a cured facing which exhibits a semi-glossy or semi-glazed finish. The moistening is effected by means of a fine water spray.

The manner in which the facing of this invention is cured is very important in terms of the compressive strength exhibited by the cured material and the color fastness thereof. It has been found, unexpectedly, that if the wet composition used herein is permitted to cure too quickly both the compressive strength and color fastness are deleteriously affected (i.e., the color fades and the strength of the cured facing is less than desired).

Figure 2:
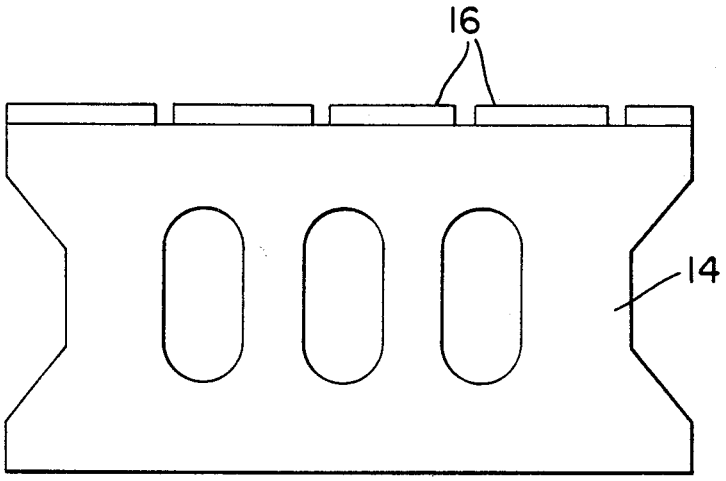
FIG. 2 is a top view of a concrete block bearing a decorative facing in accordance with another embodiment of the invention.

In FIG. 2 there is shown a conventional concrete building block 14 to one surface of which has been applied a decorative facing in accordance with the invention. The facing may be in the form of brick shapes 16, for example, or stone, tile, etc., as desired. No base coating is required when applying the decorative facing to a porous or rough concrete surface, unless it is desired to have a different color for the joint appearance between adjacent brick, tile, or stone shapes in the facing. Preferably the concrete surface of the block is sufficiently rough or uneven to enable the facing coat to adhere directly to the concrete. If additional bonding strength is desired, it is recommended to roll or brush coat a thin layer of concrete bonding adhesive onto the concrete surface prior to applying the facing material.

A mold or frame of the desired shape may be placed against the concrete surface to be faced followed by placing the wet composition in the mold and troweling flush with the top of the mold. After the composition has set sufficiently to be self-supporting (usually less than one minute), the mold may be removed. Then a fine water spray should be applied to the facing. The facing is then covered with plastic, wood, or metal for at least 12 hours (and preferably 24 hours), either by placing the facing directly down on top of the plastic, wood, or metal, or by placing the plastic, wood, or metal directly against the facing. This slows the curing process and results in a richer color for the facing and a stronger material. Allowing the facing to cure without being covered exposes the facing to air, sunlight, etc. and results in fading of the desired color and less strength than desired.

Figure 3:
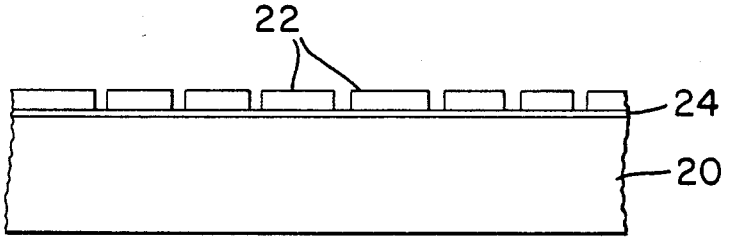
FIG. 3 is an elevational view of a portion of a concrete slab bearing a decorative facing of the invention.

In FIG. 3 there is shown an elevational view of a portion of concrete slab or pad 20 bearing a decorative facing 22 securely adhered to pad 20 by means of differently colored base coating 24, depending upon the color desired between facing elements 22. Of course, it is not necessary to include base coating 24 if the color of the concrete pad 20 is acceptable.

Figure 4:
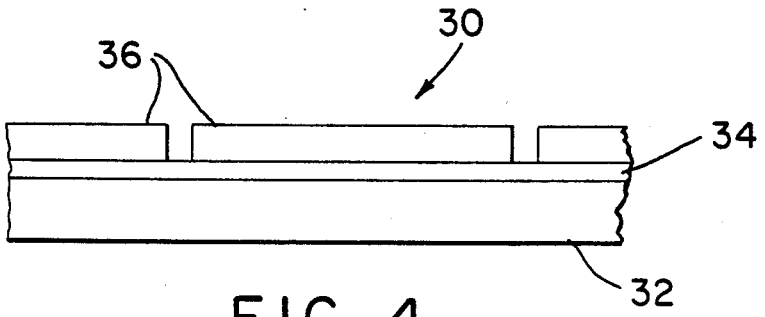
FIG. 4 is a side view of a panel bearing a decorative facing of the invention.

In FIG. 4 there is shown a side view of a panel 30 comprising a substrate 32. The top major surface bears a base coat 34. Supported by the base coat are facing elements 36 which may be of any desired shape or form, e.g., bricks, tile, stone, etc. The substrate 32 may be, for example, plywood, fiber board, or other conventional substrate in panel form (e.g., four feet by eight feet, twelve feet by sixteen feet, etc.).

The base coating as shown in FIGS. 3 and 4 preferably comprises one part by volume of Portland cement (either natural gray or white), one part fine sand (30–60 mesh), and one-half part concrete bonding adhesive (e.g., modified acetate homopolymer emulsion). Pigment may be added if it is desired to obtain a different color. Sufficient water is added to give the mix a consistency such that it may be applied to the substrate with a roller or brush.

For substrates which have a smooth surface (e.g., plywood, Celotex fiberboard, and ceiling tile) it is preferable to first apply, with a brush or roller, a thin coating of the concrete bonding adhesive and permit it to soak into the substrate. Before this adhesive coating has cured the base coating is applied evenly to a thickness of about 0.05–0.15 inch. The base coat will cure at room temperature in approximately 1 to 2 hours. It is preferred to put a fine spray of water over the coating during the curing process.

The facing coating comprises a mixture of Portland cement, sand, and pigmented binder, preferably bentonite and concrete bonding adhesive. A preferred composition is as follows:

Portland cement: 22% by volume
Sand (30–60 sieve size): 15% by volume
Sand (30–60 mesh): 30% by volume
Pigment: 30% by volume
Bentonite or sodium bentonite: 3% by volume To a mixture of these ingredients is added a mixture comprising 98% water and 2% concrete bonding adhesive, by volume, until the desired consistency is obtained. Preferably the batch size is no larger than the amount which can be used in one hour.

The pigment used in this invention is preferably a pigmented grouting commercially available from Custom Building Products. The grouting is available in a wide variety of colors and it contains Portland cement, pigment, water-retentive chemicals, and extenders. This material is particularly desired for use as a coloring pigment because the color of the resulting facing has very good aging characteristics and does not fade when the composition is cured in accordance with this invention. Additional conventional pigments may also be included, if desired.

The concrete bonding adhesive is presently preferred to be a modified acetate homopolymer emulsion commercially available from Dri-Mix. Other conventional concrete bonding adhesives may also be used, of course, if desired.

Before applying the facing coating composition to the base coat it is suggested that a fine spray of water be applied to the base coat to enhance adhesion of the face coating thereto. When the face coating is to be in a particular shape or form, an appropriately shaped mold is first placed on the base coat and then the facing composition is troweled into the mold and flush with the top thereof. If desired, additional pigments may be sprinkled dry onto the surface of the facing coating in order to achieve special coloring effects (e.g., the appearance of used brick). A very attractive surface appearance may also be obtained by applying a liquid mixture of desire pigments to the surface of the facing material prior to removing the mold. It may be applied, for example, by spraying, sponging, brushing, etc. Special texturing of the surface may also be accomplished at this time, if desired.

Within one minute the facing coating usually will set sufficiently to be self-supporting depending upon the temperature and the thickness of the facing coating. The mold, which may be made of plastic, metal (e.g., steel, aluminum, etc.), wood, etc., is then removed and a fine water spray is applied. Then the facing is covered with an air-impervious cover (e.g., plastic, wood, metal) either by placing the covering over the facing or by placing the substrate bearing the facing upside down onto the covering.

Figure 5:
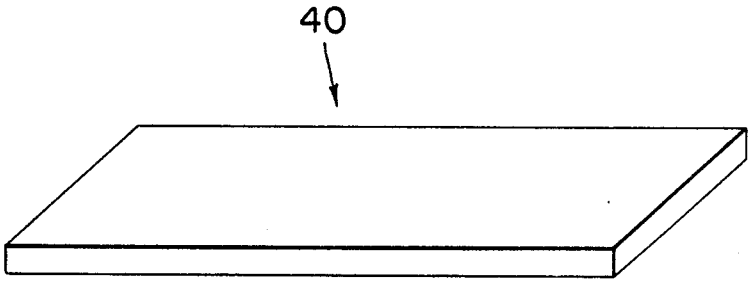
FIG. 5 is an isometric view of one form of individual decorative facing element of this invention.

In FIG. 5 there is shown an individual decorative facing element 40 (e.g., brick or tile) made in accordance with this invention. Element 40 may be made, for example, by placing the formulated finish coating into a suitably shaped mold. After about one minute the mold is removed, the mix is covered with an impervious cover, and then it is permitted to cure at room temperature (normally 40° to 80° F.) for at least 12 hours (preferably 24 hours) before being moved or handled. If the curing temperature exceeds 80° F. the cover may be sprayed with water to cool it and slow the curing process. In order to obtain a glazed surface on element 40 it has been found that placement of a plastic sheet on the bottom of the mold and then spraying it with water prior to casting the mix therein is very effective. The resulting cured element will then have a surface which exhibits a semi-gloss or semi-glaze which is very desirable for many applications.

If desired, dry pigment may be sprinkled onto the air-impervious cover prior to placement against the brick elements to be cured. The pigment will then become bonded to the surface of the brick element during the curing process. This technique is useful, for example, in obtaining a used brick appearance.

The individual brick elements 40 may be made in various thicknesses (e.g., 0.15 to 2 inches). The thinner elements are particularly useful for decorative wall facings, for example, and the thicker elements may be used as paving brick or quarry tile, for example. It is preferable to cure elements which are less than about 0.5 inch thick for at least 24 hours, preferably 36 hours, before packaging and shipment thereof, although such elements may be handled after 12–16 hours of cure if desired.

Figure 6:
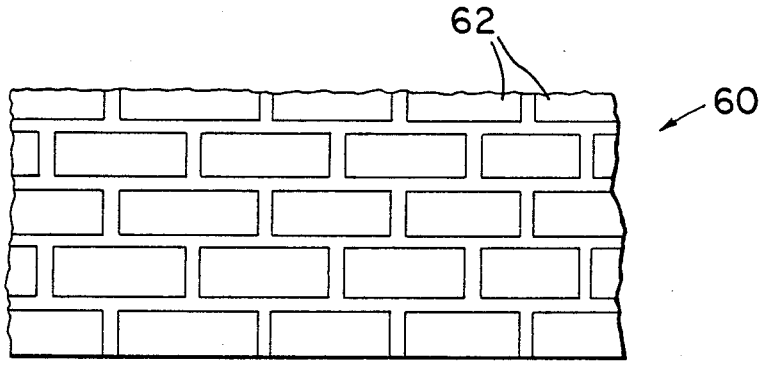
FIG. 6 is an elevational view of a portion of a concrete wall bearing the decorative facing material in accordance with this invention.

In FIG. 6 there is shown an elevational view of a portion of a wall 60 (e.g., a concrete wall) bearing a discontinuous facing coat in the form of thin brick elements 62. Brick elements 62 are preferably approximately 0.3–0.4 inch thick and have the length and width approximating a conventional brick. If the color of the wall is acceptable for the appearance of mortar in the spaces between individual facing bricks, then it is not necessary to apply a base coat to the wall. Rather, the facing coat may be applied to the wall in molded configuration over a thin layer of concrete bonding adhesive. After the facing material has set for about one minute the mold may be removed and an air-impervious cover applied over the facing material during slow-curing, as described above.

If desired, textures of various types may be imparted to the facing material while it is still in the mold. For example, the material may be troweled to a smooth surface, it may be brushed, or it may be stamped with any desired configuration.

The decorative facings and brick elements provided by this invention are characterized by high compressive strength (i.e., at least 1500 p.s.i. as measured on a two inch cube in accordance with standard engineering tests as used to test mortar mix, and preferably at least 2500–3500 p.s.i. for load bearing surfaces). They are also characterized by exhibiting high temperature color fastness (i.e., the cured materials are capable of withstanding a temperature of 1000° F. for a period of at least one hour without deterioration, degradation, cracking, or color fading). These features are achieved by slow-curing the wet composition. The slow curing technique includes covering the composition with an air-impervious cover such as plastic sheeting, metal sheets, wood, etc. and maintaining the curing temperature in the range of about 40°–80° F., preferably for at least 24 hours. If the temperature exceeds about 80° F. it is preferable to spray water on the exterior of the cover to cool the composition and slow the curing process.

EXAMPLE 1

A material suitable for making simulated bricks and other decorative facings of the invention is made using the following ingredients in the amounts stated:

| Ingredient | Parts by volume |
|---|---|
| Fine washed sand | 3 |
| Coarse sand | 9 |
| Portland cement | 4 |
| *Pigment | 5 |
| Water | 3 |
| **Concrete adhesive | 2 |

*The pigment is No. 70 Quarry Red pigmented grouting commercially available from Custom Building Products. It contains Portland cement, pigment, water-retentive chemicals, and extenders. Other conventional pigments may be included, if desired.

**The adhesive is a concrete bonding adhesive such as a modified acetate homopolymer emulsion commercially available from Dri-Mix. Other conventional concrete bonding adhesives may be used, if desired.

The sand, Portland cement, and pigments are first dry mixed. The water and adhesive are mixed together and then added to the dry mix, followed by thorough mixing. The resulting mass may be molded into various decorative facing forms, such as individual thin, rectangular shaped forms resembling brick facing, paving brick, quarry tile, etc. and slow-cured as described above, whereupon an extremely hard, durable facing material is obtained. Alternatively, the uncured mass may be coated or molded onto the surface of various substrates and then slow-cured to obtain a decorative facing, for example, resembling traditional fired brick.

A sample of the final mixture is molded into a cube having two inch sides and slow-cured at room temperature. After 24 hours the material exhibited good color and had a very hard surface and strong edges.

After seven days the cured material had a compressive strength of 1711 pounds per square inch; after 14 days it had a compressive strength of 3375 pounds per square inch. The cured material also exhibits high temperature color fastness.

EXAMPLE 2

Using the procedure of Example 1, another material useful for making decorative facings is prepared using the following ingredients in the amount stated:

| Ingredient | Parts by Volume |
|---|---|
| Fine washed sand | 3 |
| Coarse sand | 9 |
| Portland cement | 4 |
| *Pigment | 5 |
| Water | 7 |
| Bentonite | 1 |

*The pigment is the same material described in Example 1. The water and bentonite are mixed separately and then added to the dry mix of the other ingredients. The resulting mass is useful in the same manner as the material of Example 1. After slow-curing for 24 hours the material exhibited good color and had a very hard surface and strong edges.

After seven days the slow-cured material had a compressive strength of 1765 pounds per square inch; after 21 days it had a compressive strength of 1750 pounds per square inch. It also exhibits high temperature color fastness.

EXAMPLE 3

A base coat material is prepared using the following ingredients in the amounts stated:

| Ingredient | Parts by Volume |
|---|---|
| Portland cement | 1 |
| Sand | 1 |
| *Adhesive | 0.5 |

*The adhesive used is the same as described in Example 1. These ingredients are mixed together and then sufficient water is added to obtain a consistency suitable for application to a surface by means of a roller or brush. If desired, 0.5 part by volume of a desired pigment may also be added in order to obtain the desired color.

The resulting mixture is then applied as a thin layer by means of a brush or roller onto a desired surface such as plywood, particle board, Celotex (fiber board), concrete (e.g., driveways, walks, walls, floors, etc.), concrete block, cinder brick, ceiling tile, and so forth. Prior to application of the base coat the surface of the substrate is cleaned of foreign material. Some substrates such as plywood and Celotex which are quite smooth and non-porous are preferably initially coated with a concrete bonding adhesive which is capable of bonding directly to the surface of the substrate. While the adhesive is still tacky the base coat is then applied. The base coat will cure at room temperature in 1–2 hours. During the curing process a fine water spray is applied over the base coat in order to assure proper curing and good bonding to the substrate surface. The facing material (i.e., finish coat) is then applied.

The base layer not only provides the desired color to the substrate on which it is coated, but it also adheres extremely well either directly to the substrate or to the adhesive layer and provides an excellent surface to which the facing material may be applied.

EXAMPLE 4

A material suitable for making simulated bricks and other decorative facings of the invention is made using the following ingredients in the amounts stated:

| Ingredient | Parts by volume |
|---|---|
| Fine washed sand | 2 |
| Coarse sand | 8 |
| Portland cement | 5 |
| Bentonite | 1 |
| Concrete Bonding Adhesive | 2 |
| Water | 5 |

The resulting mass may be molded into various decorative facing forms, such as individual thin forms resembling brick facing, etc. and then slow-cured at room temperature (i.e., 40° to 80° F.) for a period of at least 12 hours, preferably 24 hours, while being covered with plastic, wood, metal, or other air-impervious covering. The pigmented binder in this example is the combination of concrete bonding adhesive, bentonite, and Portland cement.

In the practice of this invention it is highly preferable for the lower edge of the mold or frame to include a strip of porous material such as foam rubber bonded to such lower edge. The porous material serves two basic functions. It prevents the wet composition of the facing material from migrating under the mold and thereby undesirably discoloring the surface between individual shapes of facing material which is being applied. The second advantage of the porous material is that it may be used as a carrier for the desired coloring material between individual shapes of decorative facing material.

What is claimed is:

1. A decorative brick element having a thickness in the range of about 0.15 to 2 inches, said brick element comprising a slow-cured molded mixture of Portland cement, sand, and pigmented binder, wherein said brick element has a compressive strength characteristic of at least 1500 p.s.i. and high temperature color fastness.

2. A decorative brick element in accordance with claim 1 having a thickness in the range of about 0.2 to 0.5 inch.

3. A decorative brick element in accordance with claim 1, wherein said brick element has a length in the range of about 6 to 8 inches and a width in the range of about 1.5 to 3 inches.

4. A decorative brick element in accordance with claim 1, wherein said pigmented binder comprises pigment and concrete bonding adhesive.

5. A building block unit having securely adhered to at least one surface thereof a decorative facing, wherein said facing comprises a slow-cured mixture of Portland cement, sand, and pigmented binder, said facing having a compressive strength characteristic of at least 1500 p.s.i. and high temperature color fastness.

6. A building block unit in accordance with claim 5 comprising a concrete building block.

7. A building block unit in accordance with claim 5 comprising a cinder brick.

8. A building block unit in accordance with claim 7, wherein said facing has a thickness in the range of about 0.1 to 0.5 inch.

9. A building block unit in accordance with claim 5, wherein said pigmented binder comprises pigment and concrete bonding adhesive.

10. A building block unit in accordance with claim 5, wherein said facing has a compressive strength characteristic of at least 2500 p.s.i.

11. A decorative panel comprising a substrate having one major surface which bears a continuous base coat; wherein a discontinuous facing is securely adhered to the exterior surface of said base coat, said facing comprising a slow-cured mixture of Portland cement, sand, and pigmented binder; wherein said base coat has a thickness in the range of about 0.05 to 0.15 inch and said facing has a thickness in the range of about 0.1 to 0.5 inch; wherein said facing has a compressive strength characteristic of at least 1500 p.s.i. and high temperature color fastness.

12. A decorative panel in accordance with claim 11, wherein said substrate comprises plywood.

13. A decorative panel in accordance with claim 11, wherein said substrate comprises fiberboard.

14. A decorative panel in accordance with claim 11, wherein said pigmented binder comprises pigment and concrete bonding adhesive.

15. A method for forming a decorative facing on a surface comprising applying to said surface a mixture of Portland cement, sand, and pigmented binder at a thickness in the range of about 0.1 to 0.5 inch and then slow-curing said mixture at room temperature, whereby said mixture becomes securely adhered to said surface; wherein said facing has a compressive strength characteristic of at least 1500 p.s.i. and high temperature color fastness.

16. A method in accordance with claim 15, wherein said surface comprises concrete.

17. A method in accordance with claim 15, wherein said surface bears a base coat comprising Portland cement, sand, and concrete bonding adhesive.

18. A method in accordance with claim 15, wherein said surface comprises a concrete block.

19. A method in accordance with claim 15, wherein a mold is positioned on said surface before said mixture is applied to said surface.

20. A method in accordance with claim 19, wherein the underside of said mold comprises foam.

* * * * *